US006047752A

United States Patent [19]

Southwick

[11] Patent Number: 6,047,752

[45] Date of Patent: Apr. 11, 2000

[54] HANDBAG SYSTEM

[76] Inventor: Linda S. Southwick, 13427 N. Canterbury Dr., Phoenix, Ariz. 85023

[21] Appl. No.: 09/063,522

[22] Filed: Apr. 21, 1998

[51] Int. Cl.[7] ..... A45C 1/02; A45C 3/06

[52] U.S. Cl. ..... 150/117; 150/112; 150/118; 190/902; 206/320

[58] Field of Search ..... 150/102, 106, 150/112, 113, 117, 118; 190/116, 117, 902; 206/90, 320; 224/914

[56] References Cited

U.S. PATENT DOCUMENTS

| | | | |
|---|---|---|---|
| 1,464,176 | 8/1923 | Freund | 150/106 X |
| 1,895,018 | 1/1933 | Wolf | 150/106 X |
| 2,413,465 | 12/1946 | Ohlsen | 150/117 |
| 3,286,751 | 11/1966 | Dishart | 150/106 X |
| 3,678,977 | 7/1972 | Baumgartner | 150/117 X |
| 3,955,609 | 5/1976 | Siegel | 150/117 |
| 3,963,102 | 6/1976 | Carp | 150/106 X |
| 4,301,898 | 11/1981 | Plough et al. | 150/117 X |
| 4,424,841 | 1/1984 | Smith | 190/116 X |
| 4,739,809 | 4/1988 | Adams | 150/112 |
| 4,801,059 | 1/1989 | Hayes | 150/117 X |
| 5,009,319 | 4/1991 | Jantzen | 150/118 X |
| 5,119,910 | 6/1992 | Heggeland | 190/116 |
| 5,662,219 | 9/1997 | Tschudy et al. | 150/113 X |

*Primary Examiner*—Sue A. Weaver
*Attorney, Agent, or Firm*—Martin L. Stoneman

[57] ABSTRACT

Disclosed is a handbag system having a substantially rectangular body with an open middle compartment. Within the middle compartment are a plurality of sub-compartments sized for holding various personal safety items such as mace, a wireless phone and a pager. A closure flap is provided for partially covering the middle compartment. The closure flap is sized and arranged to allow unrestricted access to those personal safety items which are adjacent to the sides of the body when the closure flap is in a closed position. A closeable front and rear compartment are provided to store other miscellaneous personal items.

11 Claims, 3 Drawing Sheets

FIG. 6
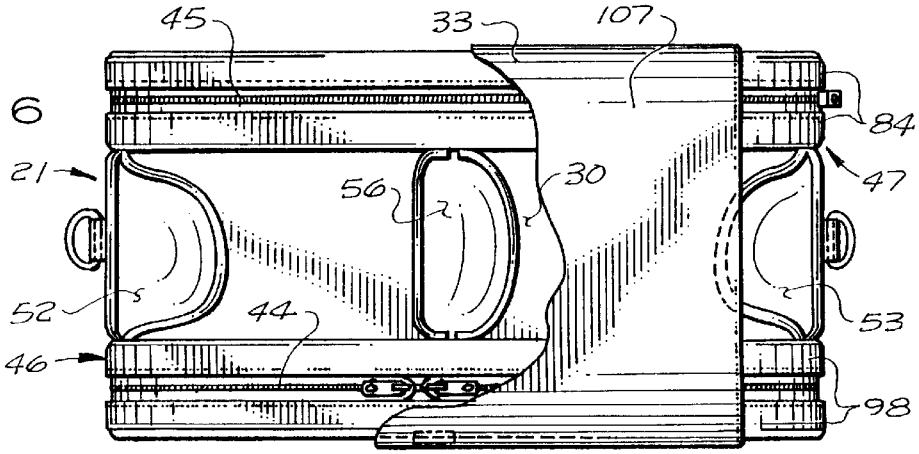
FIG. 7
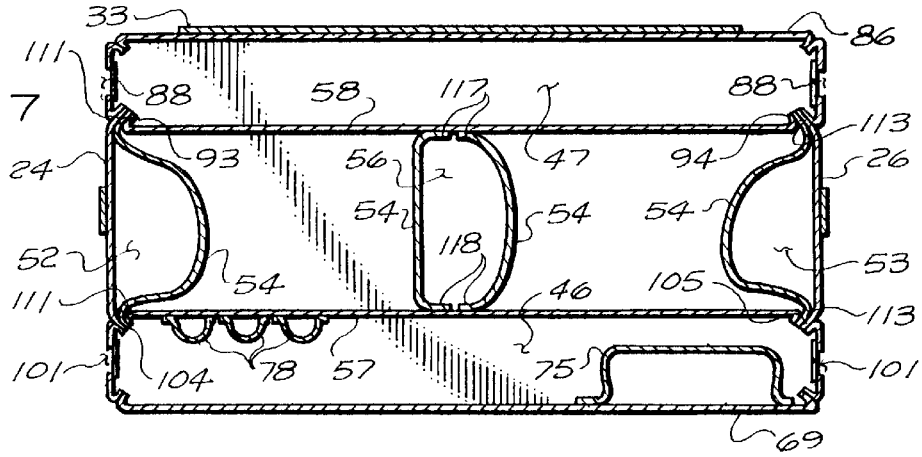
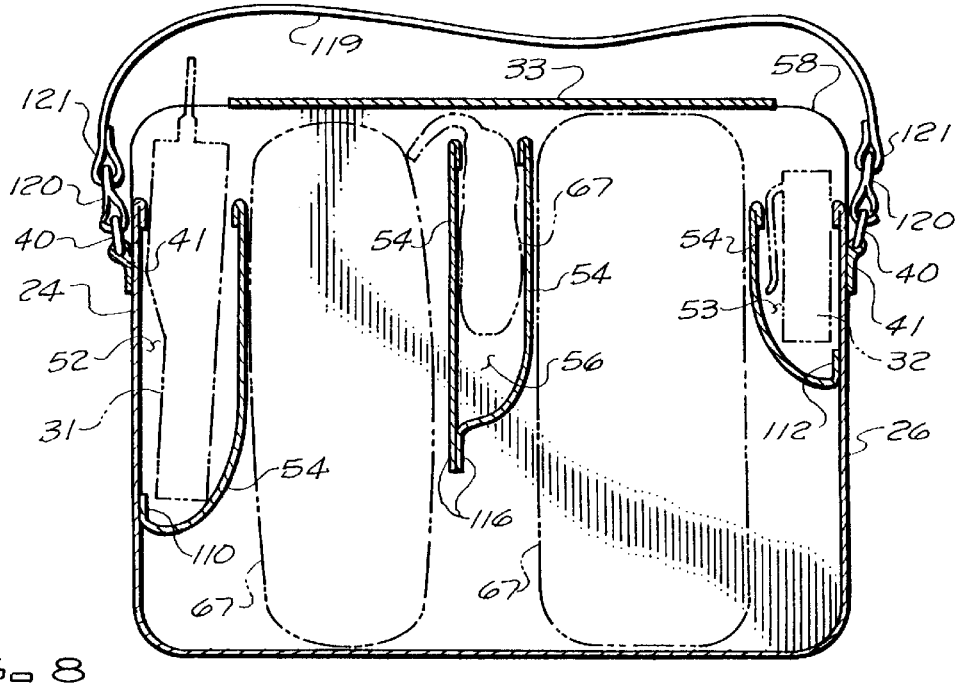
FIG. 8

HANDBAG SYSTEM

BACKGROUND OF THE INVENTION

1. Field of the Invention

This invention relates to providing a handbag system. More particularly, this invention concerns a handbag system for providing compartmentalized and quick unobstructed access to a choice of personal wireless telephone, a mace container, a pager and other personal safety items.

2. Description of the Prior Art

Typically, portable handbags are used to transport a number of personal items which the user may require when away from the user's residence. These personal items generally comprise such articles as wallets, checkbooks, cosmetics, day-planners, keys and other such articles that the user may require during the course of any given day. The recent trend towards wireless technology has brought to the public such items as wireless telephones and pagers which enable the user to communicate with others when away from the home or office. These devices also require a convenient and handy means to store and transport such devices which are quickly accessible when needed, as for personal safety considerations.

In the past, the typical means to transport such items has been by the use of a conventional purse-type bag. These bags generally have at least one large compartment in which is placed the user's personal items. The use of only a single compartment requires the user to search through the aggregate mass of personal items in order to find the needed item. When certain items are needed quickly such as a mace container, the delay in having to search can result in personal harm to the user. In addition, wireless telephones and pagers generally come equipped with clip-type devices to clip onto the garment of the user, such as a pocket or a belt. This method of transporting these devices is convenient if user is wearing either a belt or a garment that has pockets, otherwise other means of transporting these devices so that they are quickly accessible is required.

OBJECTS OF THE INVENTION

A primary object of the present invention is to fulfill the above-mentioned needs by the provision of a compartmentalized handbag which allows for quick access to a number of personal items. A further primary object of the present invention is to provide such a handbag that is inexpensive, convenient to carry, and simple to use. Another object of this invention is to provide such a handbag that is simple to manufacture. A further object of this invention is to provide such a handbag that is pleasing in appearance. Other objects and features of this invention will become apparent with reference to the following invention descriptions.

SUMMARY OF THE INVENTION

According to a preferred embodiment of the present invention, this invention provides a handbag for permitting easy access to a choice among a personal wireless telephone, a mace container, a pager and other personal-safety items comprising, in combination: body means for carrying handbag contents, such body means comprising a front portion, a rear portion, two side portions, and a bottom portion, and having an open top portion having a longitudinal extension; first closure means, having a closed position and an open position, for protecting such open-top portion; and first open-top holding means, in such body means and beneath such open top portion, adjacent a first such side portion, for holding a personal-safety item; wherein such first closure means, when in such closed position, does not restrict user access to such first open-top holding means.

Additionally, this invention provides such a handbag further comprising: second open-top holding means, in such body means and beneath such open top portion, adjacent a second such side portion, for holding a personal-safety item; wherein such first closure means, when in such closed position, does not restrict user access to such second open-top holding means. And, it provides such a handbag further comprising third holding means, in such body means and adjacent such rear portion, for holding briefcase-type business materials; and second closure means for separately closing such third holding means. Also, it provides such a handbag further comprising: fourth holding means, in such body means and adjacent such front portion, for holding credit-card and banking materials; and third closure means for separately closing such fourth holding means; wherein such third closure means comprises perimeter means for closing such fourth holding means along a perimeter of such fourth holding means; and wherein such perimeter means extends for at least about three-fourths of such perimeter.

Moreover, this invention provides such a handbag further comprising: fifth holding means for holding a pair of eyeglasses; wherein such first closure means, when in such closed position, does restrict user access to such fifth holding means. Yet further, this invention provides such a handbag wherein such open-top portion of such body means comprises multiple transverse dividing means for dividing such longitudinal extension of such open-top portion of such body means into multiple compartments. And, it provides such a handbag further comprising: a detachable, adjustable handle for such body means, such handle being user-selectable from a group comprising a first handle and a second handle; such first handle comprising a shorter briefcase-style handle, and such second handle comprising a longer shoulder-strap-style handle.

Even further, this invention provides such a handbag wherein such first closure means comprises: a flap having a central portion and a first end and a second end, such first end being attached to such body means and such second end being detachably attachable to such body means; such flap being constructed and arranged for such central portion to be removably placed transversely over such longitudinal extension. And, it provides such a handbag wherein such central portion of such flap, when such flap is in such closed position, does not restrict user access to such open-top portion adjacent such side portions. Yet additionally, the present invention provides for a handbag further comprising: second open-top holding means, in such body means and beneath such open top portion, adjacent a second such side portion, for holding a safety item; wherein such first closure means, when in such closed position, does not restrict user access to such second open-top holding means; and wherein such open-top portion of such body means comprises multiple transverse dividing means for dividing such longitudinal extension of such open-top portion of such body means into multiple compartments.

Yet further still, the present invention provides for a handbag further comprising: third holding means, in such body means and adjacent such rear portion, for holding briefcase-type business materials; second closure means for separately closing such third holding means; fourth holding means, in such body means and adjacent such front portion, for holding credit-card and banking materials; and third closure means for separately closing such fourth holding means; wherein such third closure means comprises perimeter means for closing such fourth holding means along a perimeter of such fourth holding means; and wherein such perimeter means extends for at least about three-fourths of such perimeter.

Even additionally, according to a preferred embodiment of the present invention, this invention provides a handbag for permitting easy access to a choice among a personal wireless telephone, a mace container, a pager and other personal-safety items comprising, in combination: a rectangular-box-like body having a rear compartment, an open-top middle compartment, and a front compartment, each such compartment extending longitudinally essentially along the full length of such body from a first side of such body to a second side of such body; such middle compartment having multiple transverse dividers providing multiple sub-compartments within such middle compartment; such sub-compartments comprising: a first sub-compartment at a such first side of such body, such first sub-compartment being structured and arranged to hold a personal-safety item, and a second sub-compartment at a such second side of such body, such second sub-compartment being structured and arranged to hold a personal-safety item; and an outside transversely-extending closure flap structured and arranged, when in a closed position, to be placed generally centrally over such body; such flap having a width of substantially less distance than a length of such middle compartment, and such flap being structured and arranged, when in such closed position, so as to not restrict user access to such first sub-compartment and such second sub-compartment.

Furthermore, the present invention provides for a handbag wherein such rear compartment and such front compartment are each zipper-closable. Also, it provides for a handbag wherein at least one such zipper-closable compartment comprises a perimeter zipper extending around such compartment for at least about three-fourths of a perimeter of such compartment. And, it provides for a handbag wherein at least one of such zipper-closable compartments is structured and arranged for holding briefcase-type business materials. Additionally, the present invention provides for a handbag wherein at least one of such zipper-closable compartments is structured and arranged for holding credit-card and banking materials. Still further, the present invention provides for a handbag further comprising a short, briefcase-style handle, such handle being detachable from such body.

Even additionally still, according to a preferred embodiment thereof, the present invention provides a handbag for permitting easy access to a choice among a personal wireless telephone, a mace container, a pager and other personal-safety items comprising, in combination: a rectangular-box-like body having a rear compartment, an open-top middle compartment, and a front compartment, each such compartment extending longitudinally essentially along the full length of such body from a first side of such body to a second side of such body; such middle compartment having multiple transverse dividers providing multiple sub-compartments within such middle compartment; such sub-compartments comprising a first sub-compartment at a such first side of such body, such first sub-compartment being structured and arranged to hold a personal-safety item, and a second sub-compartment at a such second side of such body, such second sub-compartment being structured and arranged to hold a personal-safety item; an outside transversely-extending closure flap structured and arranged, when in a closed position, to be placed generally centrally over such body; such flap having a width of substantially less distance than a length of such middle compartment, and such flap being structured and arranged, when in such closed position, so as to not restrict user access to such first sub-compartment and such second sub-compartment; a center sub-compartment disposed within such body between such first sub-compartment and such second sub-compartment; a logo indicia attached to a front surface of such closure flap; and a detachable, adjustable handle for such body means, such handle being user-selectable from a group comprising a first handle and a second handle; wherein such rear compartment and such front compartment are each zipper-closable; wherein at least one such zipper-closable compartment comprises a perimeter zipper extending around such compartment for at least about three-fourths of a perimeter of such compartment; and wherein such first handle comprising a shorter briefcase-style handle, and such second handle comprising a longer shoulder-strap-style handle.

Yet further, it provides such a handbag wherein such body is made of leather. And, it provides such a handbag wherein: such body has a length dimension of about thirteen inches and a height dimension of about ten inches; and said flap has a said width of at least about two inches less than a said length of said middle compartment, whereby said flap, when in said closed position, does not restrict user access to said first sub-compartment and said second sub-compartment.

BRIEF DESCRIPTION OF THE DRAWINGS

FIG. 6 is a top view, partially cut away, of the preferred embodiment illustrated and described in FIG. 1.

FIG. 7 is a cross-sectional plan view through section 7—7 of FIG. 1.

FIG. 8 is a cross-sectional elevation view through section 8—8 of FIG. 1, showing in alternate detail the location of personal items in the handbag.

DETAILED DESCRIPTION OF A PREFERRED EMBODIMENT AND THE BEST MODE OF PRACTICE

Figure 1:
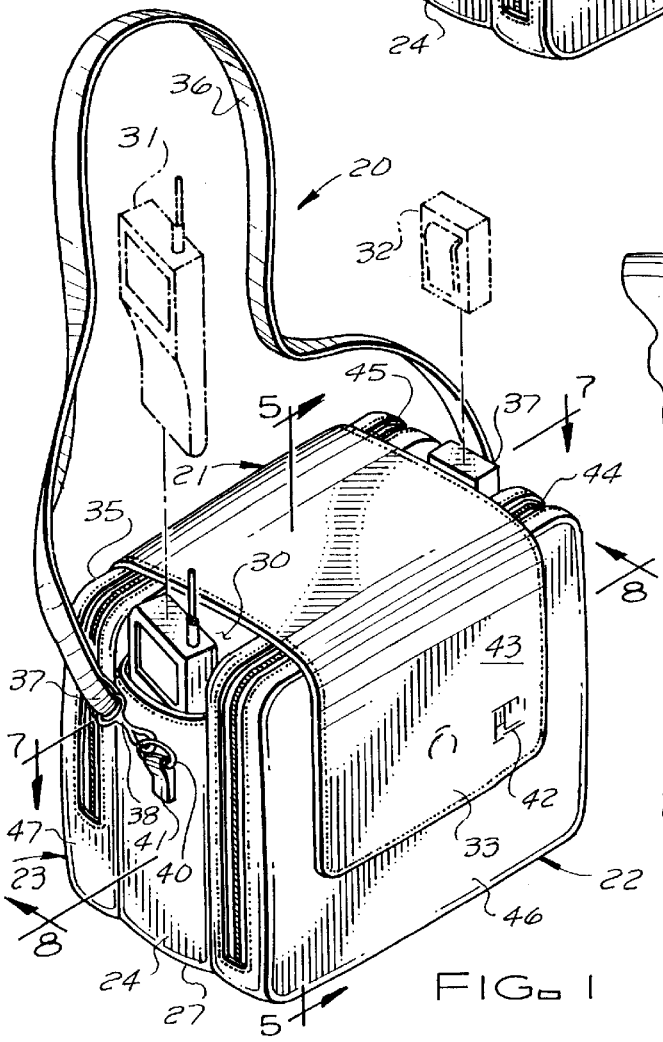
FIG. 1 is a perspective view of a preferred embodiment of the handbag system of the present invention.

Illustrated in FIG. 1, in perspective, is a preferred embodiment of the handbag system 20 of the present invention. Shown is a rectangular-box-like body or bag portion 21 having a front portion 22, a rear portion 23, a first side wall 24, a second side wall 26 (as shown best in FIGS. 6–8), and a bottom portion 27. The bag portion 21 is preferably formed from a leather or micro fiber-type material which is stitched or otherwise secured together in a manner familiar to those skilled in such art. As shown in FIG. 1, the individual components comprising the bag portion 21 are structured and arranged to form an open middle compartment 30, extending longitudinally between the first side wall 24 and second side wall 26, for storing an assortment of personal items such as a wireless telephone 31 and pager 32. Bag portion 21 embodies in the present invention a body means for carrying handbag contents, such body means comprising a front portion, a rear portion, two side portions, and a bottom portion, and having an open top portion having a longitudinal extension.

Figure 4:
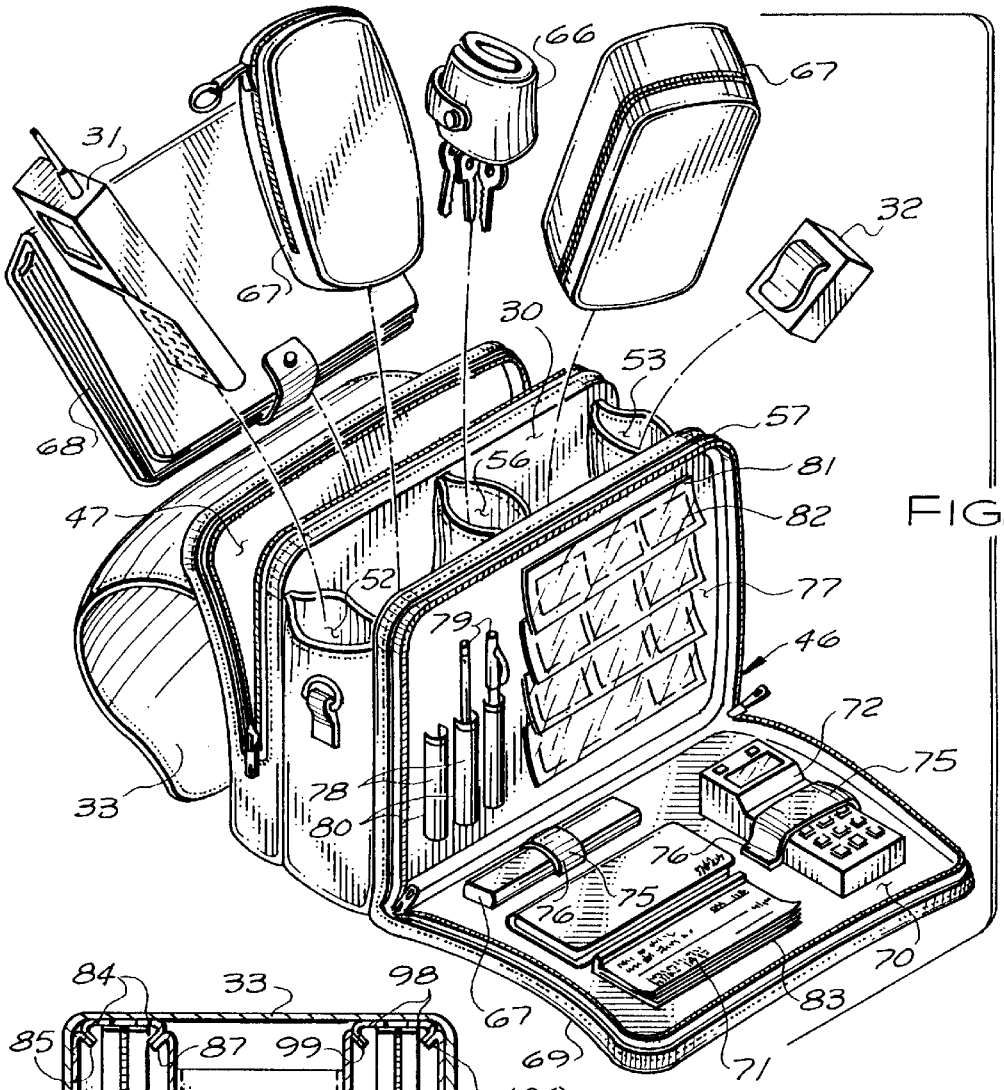
FIG. 4 is an exploded perspective view illustrating the individual compartments of the handbag system.
Figure 5:
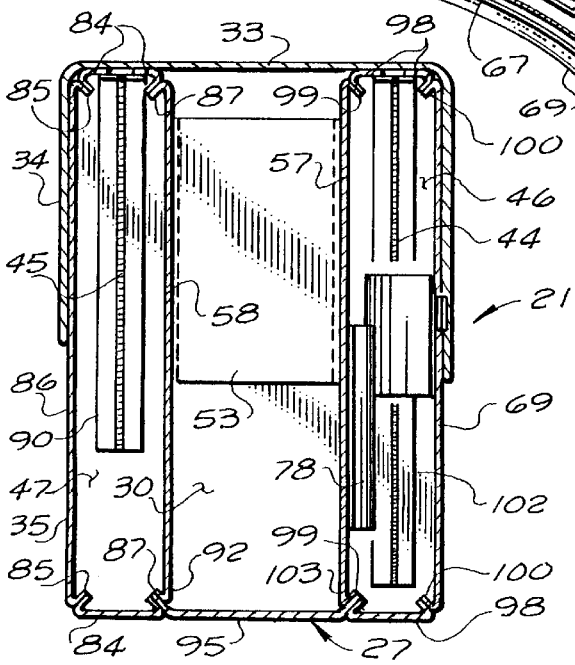
FIG. 5 is a cross-sectional view through the section 5—5 of FIG. 1.

The present invention also provides for an outside transversely-extending closure flap 33 having a flap first end 34 which is hingedly affixed, preferably by stitching, to rear face 35 (as shown best in FIG. 5). When closure flap 33 is in a closed position, as shown in FIG. 1, partial access is still permitted to the contents within the middle compartment 30 which are adjacent to the first side wall 24 and second side wall 26. Closure flap 33 embodies herein a first closure means, having a closed position and an open position, for protecting such open-top portion. As described more in detail with respect to FIG. 6, it is an important feature of this invention that the closure flap 33 is sized and arranged so that the sub-compartments holding, for example, wireless telephone 31 or pager 32 are exposed when the closure flap 33 is in a closed position. This arrangement allows for quick access (as a personal safety feature) to those personal items contained within each respective sub-compartment, thereby eliminating the need to open the closure flap 33 to obtain access to these items. To provide a means to comfortably transport the handbag system 20, a handle or carry strap 36, preferably of the adjustable type and made of preferably a leather material, is provided. Attached to each looped end 37 of carry strap 36 is a connector 38, preferably of the quick-release type to allow for removal of the carry strap 36, which is optionally attached to rings 40. Each of rings 40 are preferably made of a metal material and are attached in a manner readily apparent to those skilled in the art to ring tabs 41. Each of the ring tabs 41 are preferably made of a leather material and are attached, preferably by stitching or riveting, to each side wall 24 and 26 respectively. The present invention also provides for a logo-type indicia 42 which is attached, preferably by stitching, to the front surface 43 of closure flap 33, as shown. Also shown in FIG. 1 is a front fastener 44 and a rear fastener 45 for fastening, respectively, a front compartment 46 (adjacent to front portion 22) and a rear compartment 47 (adjacent to rear portion 23), the details of which will be more fully disclosed hereinafter with respect to FIGS. 4–7.

Figure 2:
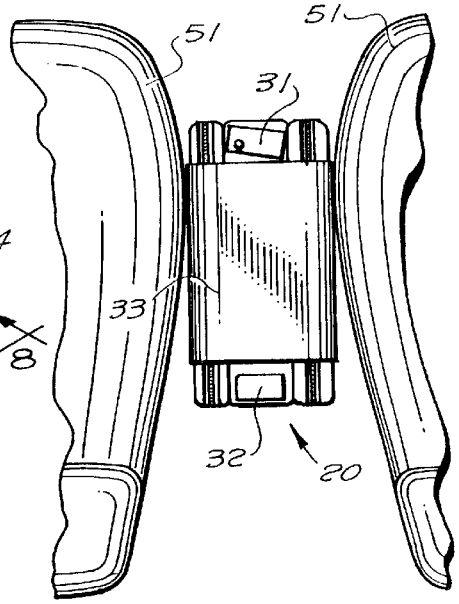
FIG. 2 is a right side elevation view of the handbag system stored between the seats of a vehicle.

The handbag system 20 is structured to be efficient in size, having a preferred front dimension of 10 inches high by 13 inches long. As FIG. 2 illustrates, the handbag system 20 may conveniently be stored between the seats 51 of most automobiles. Such convenient storage allows for quick access to the contents of the middle compartment 30, such as a wireless telephone 31 and/or mace container or pager 32 thereby eliminating the need to search for such items while driving.

Figure 3:
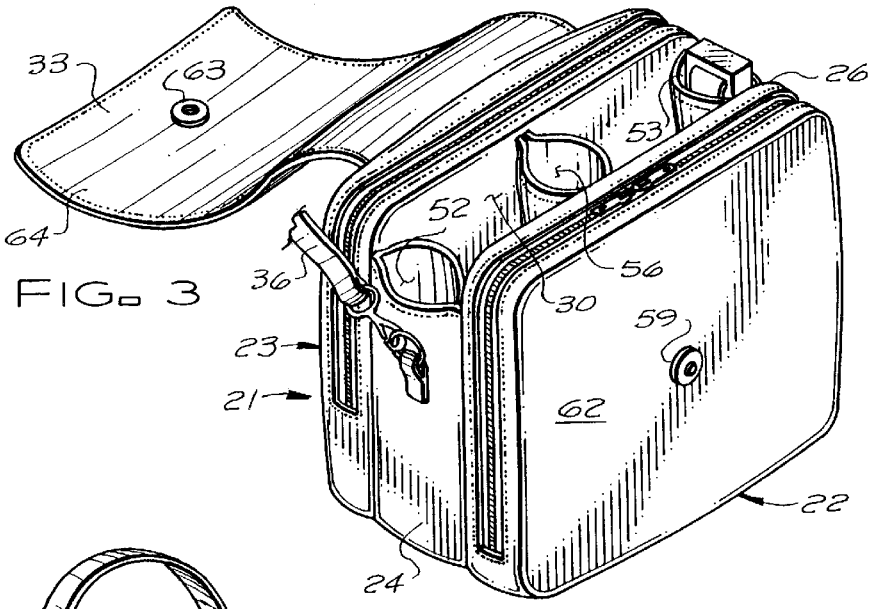
FIG. 3 is a perspective view of the handbag system illustrating the arrangement of the interior compartment.

Illustrated in FIG. 3 is the handbag system 20, in perspective, with the closure flap 33 in an open position. To provide a means to conveniently store those personal items which are used frequently such as a wireless telephone 31 or pager 32, a first sub-compartment 52 (embodying herein a first open-top holding means, in such body means and beneath such open top portion, adjacent a first such side portion, for holding a personal-safety item) and a second sub-compartment 53 (embodying herein a second open-top holding means, in such body means and beneath such open top portion, adjacent a second such side portion, for holding a personal-safety item) are provided within the middle compartment 30. Sub-compartments 52 and 53 are formed by attaching, in a manner readily apparent to one skilled in the art, dividers 54, preferably made of a leather or micro fiber-type material, to each respective side wall 24 and 26. As explained more fully hereinafter with respect to FIG. 8, each respective sub-compartments 52 and 53 is sized to accommodate those personal items which are used most often or which may be needed quickly. Another component of the present handbag system 20 is a center sub-compartment 56 located within the middle compartment 30 substantially midway between the first side wall 24 and the second side wall 26 as shown in FIG. 3. As will be explained more fully hereinafter with respect to FIGS. 7 and 8, center sub-compartment 56 is formed by attaching, preferably by stitching, a pair of dividers 54 to the first interior wall 57 and the second interior wall 58 thereby forming a pocket or receptacle for holding eyeglasses or other personal items. Center sub-compartment 56 embodies herein a fifth holding means for holding a pair of eyeglasses. In the present invention, the dividers 54 embody an arrangement wherein such open-top portion of such body means comprises multiple transverse dividing means for dividing such longitudinal extension of such open-top portion of such body means into multiple compartments. Also shown in FIG. 3 is a flap fastener 59 attached to the exterior surface 62 of front portion 22, for use in securing the closure flap 33 in a closed position. Flap fastener 59 is structured and arranged to engage a cooperative female fastener 63 which is secured adjacent to the closure flap second end 64.

Shown in FIG. 4 is an exploded perspective view of the handbag system 20 of the present invention illustrating the assortment of personal items which may be stored therein. Shown is a possible method of carrying various person items in the middle compartment 30 such as a wireless telephone 31, pager 32, keys 66 and other miscellaneous items (labeled in general as 67). In addition, the rear compartment 47 is provided for storing larger items such as a day planner 68 or other briefcase-type business materials. Rear compartment 47 embodies herein a third holding means, in such body means and adjacent such rear portion, for holding briefcase-type business materials. Other specific items may be stored in the front compartment 46 which comprises a front wall 69 having an interior surface 70. Other personal items may be removably attached to interior surface 70, such as a checkbook 71 and calculator 72 and/or other banking materials. Front compartment 46 embodies herein a fourth holding means, in such body means and adjacent such front portion, for holding credit-card and banking materials. Loops 75 are used to attach the calculator 72 and other miscellaneous items 67 to the interior surface 70. Loops 75 are preferably made of an elastic material which is preferably attached to interior surface 70 by stitching the loop ends 76 to front wall 69. Likewise, the exterior side 77 of first interior wall 57 are provided with a plurality of holders 78, preferably made of an elastic material, for storing a plurality of pens or pencils 79. The formation of holders 78 consists of attaching, preferably by stitching, holder ends 80 to exterior side 77.

Also shown in FIG. 4 is a plurality of card holders 81, preferably made of a vinyl material, for holding business or credit cards 82. Cardholders 81 are preferably attached to exterior side 77 by cutting longitudinal slots (not shown) in the material comprising the exterior side 77 which are sized to receive a back flap (not shown) of card holders 81. The preferable method of attaching the checkbook 71 to interior surface 70 consists of cutting a longitudinal slot (not shown) in the material comprising the inner surface 70 of sufficient size to receive a longitudinal edge 83 of checkbook 71.

FIG. 5 is a left side elevation view, in cross-section, illustrating the arrangement of the various compartments comprising the handbag system 20. Formation of rear compartment 47 consists of attaching, preferably by stitching, a rear perimeter strip 84, structured to form an openable perimeter wall around rear compartment 47, to both the first perimeter edge 85 of rear wall 86 and the second perimeter edge 87 of the second interior wall 58. The rear perimeter strip 84 is preferably made of leather or micro fiber-type material and is sized to provide a rear compartment 47 with a substantially rectangular cross-section as shown in FIG. 5. A rear opening 88 (as shown best in FIG. 7) is provided in rear perimeter strip 84 sized so as to allow convenient access to rear compartment 47. A rear fastener 45, preferably a zipper-type fastener, is incorporated to provide a means to completely close the rear compartment 47 when not in use. Rear fastener 45 embodies herein a second closure means for separately closing such third holding means. The rear fastener 45 is attached, preferably by stitching, to the rear perimeter edge 90 of rear opening 88. Separating the rear compartment 47 from the middle compartment 30 is the second interior wall 58 having a second interior wall bottom end 92, a first side edge 93 (as shown best in FIG. 7) and a second side edge 94 (as shown best in FIG. 7) which are attached, preferably by stitching, to respectively the bottom panel 95, the first side wall 24 and the second side wall 26.

Formation of front compartment 46 consists of attaching, preferably by stitching, a front perimeter strip 98 to both the third perimeter edge 99 of first interior wall 57 and to the fourth perimeter edge 100 of front wall 69. The front perimeter strip 98 is structured to form an openable perimeter wall around front compartment 46 and is provided with a front opening 101 (as shown best in FIG. 7) sized so as to allow convenient access to front compartment 46. The front perimeter strip 98 is preferably made of leather or micro fiber-type material and is sized to provide a front compartment 46 with a substantially rectangular cross-section as shown in FIG. 5. A front fastener 44, preferably a zipper-type fastener, is incorporated to provide a means to completely close the front compartment 46. Front fastener 44 embodies herein a third closure means for separately closing such fourth holding means. The front fastener 44 is attached, preferably by stitching, to the front perimeter edge 102 of the front opening 101 (this arrangement embodying herein an arrangement wherein such third closure means comprises perimeter means for closing such fourth holding means along a perimeter of such fourth holding means). As shown in FIG. 5, front fastener 44 is structured and arranged to extend approximately three-quarters around the perimeter of front compartment 46 (such arrangement embodying herein an arrangement wherein such perimeter means extends for at least about three-fourths of such perimeter). This arrangement permits front wall 69 to lie in a substantially horizontal position when front fastener 44 is fully disengaged, thus allowing the user to use the checkbook 71 without removing it from front wall 69.

Separating the front compartment 46 from the middle compartment 30 is the first interior wall 57 having a first interior wall bottom edge 103, a first side edge 104 (as shown best in FIG. 7) and a second side edge 105 (as shown best in FIG. 7) which are attached, preferably by stitching, to respectively the bottom panel 95, the first side wall 24 and the second side wall 26. Also shown in FIG. 5 is the second sub-compartment 53 disposed within the middle compartment 30 adjacent the first side wall 24 and second side wall 26.

Shown in FIGS. 6 and 7 are top views (in partial cut-away and in cross-section respectively) of the handbag system 20 of the present invention. As specifically illustrated in FIG. 6, the closure flap 33 is structured and arranged so that closure flap central portion 107 lies transversely over the middle compartment 30. As shown in FIG. 6, the closure flap 33 is sized and arranged so that the first sub-compartment 52 and second sub-compartment 53 are exposed when the closure flap 33 is in a closed position (this arrangement embodying an arrangement wherein such first closure means, when in such closed position, does not restrict user access to such first open-top holding means, and wherein such first closure means, when in such closed position, does not restrict user access to such second open-top holding means). For example, in a preferred embodiment wherein the length of the upper opening of the handbag is about thirteen inches, the closure flap 33 is preferred to be only about 10 to about 11 inches wide, thus preferably leaving at least about one inch on each side of a closed closure flap 33 for access as described and shown herein. This arrangement allows for quick access to those personal items contained within each respective sub-compartment 52 and 53, thereby eliminating the need to open the closure flap 33 to obtain access to these items. Those smaller items which may not need to be accessed quickly such as keys 66 and sunglasses may be held in the center sub-compartment 56. Access to these items in the center sub-compartment 56 is possible only when closure flap 33 is in the open position (this arrangement embodying herein an arrangement wherein such first closure means, when in such closed position, does restrict user access to such fifth holding means) as best shown in FIG. 3. Shown in FIG. 7, in cross-section, is a top view of the arrangement of the various compartments and holders comprising the present handbag system 20 of the present invention as illustrated and described hereinbefore with respect to FIGS. 1–6.

Each of the respective first sub-compartment 52, second sub-compartment 53 and center sub-compartment 56 are sized and arranged to hold items of a specific size which may be needed to be accessed quickly as shown in the cross-sectional elevation view of FIG. 8. For example, the first sub-compartment 52 is sized to form a pocket which may carry a standard-sized wireless telephone 31. The second sub-compartment 53 is sized to hold smaller items which may require quick access such as mace containers or a pager 32. Formation of the first sub-compartment 52 consists of attaching, preferably by stitching, the first bottom end 110 and each respective first edge portions 111 (as shown in FIG. 7) of pocket wall piece 54 to the first side wall 24. In a similar manner, formation of the second sub-compartment 53 consists of attaching, preferably by stitching, the second bottom end 112 and each respective second edge portions 113 (as shown in FIG. 7) of dividers 54 to the second side wall 26. As shown in FIG. 7, each of the first sub-compartment 52 and second sub-compartment 53 is preferably sized to substantially span the transverse distance between the first side wall 57 and the second side wall 58.

As is further shown in FIGS. 7 and 8, the center sub-compartment 56 is formed by attaching, preferably by stitching, the center bottom ends 116 of the dividers 54 together. The center rear edge portions 117 (as best shown in FIG. 7) of dividers 54 are then attached, preferably by stitching, to the second interior wall 58. Finally, the center front edge portions 118 (as best shown in FIG. 7) of dividers 54 are attached, preferably by stitching, to the first interior wall 57. The incorporation of the center sub-compartment 56 into the middle compartment 30 allows for storage of larger miscellaneous items (labeled generally as 67) between the center sub-compartment 56 and the sub-compartments 52 and 53 respectively. Furthermore, customizing the pocket size of each respective sub-compartment 52, 53 and 56 allows for storage of smaller items under each respective pocket, thereby increasing the carrying capacity of the handbag system 20.

According to another preferred embodiment of the present invention, the handbag system 20 is provided with a briefcase-style handle 119 as shown in FIG. 8. Handle 119 is preferably made of a leather material and is attached to bag portion 21 by the use of connectors 120, preferably of the quick-disconnect type, which are attached to the looped handle ends 121. The connectors 120 are removably attached to the bag portion 21 by use of rings 40 and ring tabs 41 hereinbefore illustrated and described with respect to FIG. 1.

Although applicant has described applicant's preferred embodiments of this invention, it will be understood that the broadest scope of this invention includes such modifications as diverse shapes, sizes and materials. Such scope is limited only by the below claims as read in connection with the above specification.

What is claimed is:

1. A handbag for permitting easy access to a choice among a personal wireless telephone, a mace container, a pager and other personal-safety items comprising, in combination:

(a) a rectangular-box-like body having a rear compartment, an open-top middle compartment, and a front compartment, each said compartment extending longitudinally essentially along the full length of said body from a first side of said body to a second side of said body;

(b) said middle compartment having multiple transverse dividers providing multiple sub-compartments within said middle compartment;

(c) said sub-compartments comprising;

(i) a first sub-compartment at a said first side of said body, said first sub-compartment being structured and arranged to hold a personal-safety item, and (ii) a second sub-compartment at a said second side of said body, said second sub-compartment being structured and arranged to hold a personal-safety item; and (d) an outside transversely-extending closure flap structured and arranged, when in a closed position, to be placed generally centrally over said body;

(e) said flap having a width of substantially less distance than a length of said middle compartment, and said flap being structured and arranged so that said first sub-compartment and said second sub-compartment remain exposed when said flap is in said closed position;

(f) wherein said first sub-compartment is structured and arranged for holding an item having dimensions of at least the size of the wireless telephone.

2. The handbag of claim 1 wherein said rear compartment and said front compartment are each zipper-closable.

3. The handbag of claim 2 wherein at least one said zipper-closable compartment comprises a perimeter zipper extending around said compartment for at least about three-fourths of a perimeter of said compartment.

4. The handbag of claim 3 wherein at least one of said zipper-closable compartments is structured and arranged for holding briefcase-type business materials.

5. The handbag of claim 4 wherein at least one of said zipper-closable compartments is structured and arranged for holding credit-card and banking materials.

6. The handbag of claim 5 further comprising a short, briefcase-style handle, said handle being detachable from said body.

7. The handbag of claim 5 further comprising a detachable, adjustable handle comprising a shoulder-strap-style handle.

8. A handbag permitting easy access to a choice among a personal wireless telephone, a mace container, a pager and other personal-safety items comprising, in combination:

(a) a rectangular-box-like body having a rear compartment, an open-top middle compartment, and a front compartment, each said compartment extending longitudinally essentially along the full length of said body from a first side of said body to a second side of said body;

(b) said middle compartment having multiple transverse dividers providing multiple sub-compartments within said middle compartment;

(c) said sub-compartments comprising:

(i) a first sub-compartment at a said first side of said body, said first sub-compartment being structured and arranged to hold a personal-safety item, and (ii) a second sub-compartment at a said second side of said body, said second sub-compartment being structured and arranged to hold a personal-safety item;

(d) an outside transversely-extending closure flap structured and arranged, when in a closed position, to be placed generally centrally over said body;

(e) said flap having a width of substantially less distance than a length of said middle compartment, and said flap being structured and arranged so that said first sub-compartment and said second sub-compartment remain exposed when said flap is in said closed position;

(f) a center sub-compartment disposed within said body between said first sub-compartment and said second sub-compartment;

(g) a logo indicia attached to a front surface of said closure flap; and (h) a detachable, adjustable handle for said body means, said handle being user-selectable from a group comprising a first handle and a second handle;

(i) wherein said rear compartment and said front compartment are each zipper-closable;

(j) wherein at least one said zipper-closable compartment comprises a perimeter zipper extending around said compartment for at least about three-fourths of a perimeter of said compartment;

(k) wherein said first handle comprising a shorter briefcase-style handle, and said second handle comprising a longer shoulder-strap-style handle; and (l) wherein said first sub-compartment is structured and arranged for holding an item having dimensions of at least the size of the wireless telephone.

9. The handbag of claim 8 wherein said rectangular-box-like body is made of leather.

10. The handbag of claim 9 wherein:

(a) said rectangular-box-like body has a length dimension of about thirteen inches and a height dimension of about ten inches; and (b) said flap has a said width of at least about two inches less than a said length of said middle compartment, whereby said flap, when in said closed position, does not restrict user access to said first sub-compartment and said second sub-compartment.

11. A handbag permitting easy access to a choice among a personal wireless telephone, a mace container, a pager and other personal-safety items comprising, in combination:

(a) a rectangular-box-like body having a rear compartment, an open-top middle compartment, and a front compartment, each said compartment extending longitudinally essentially along the full length of said body from a first side of said body to a second side of said body;

(b) said middle compartment having multiple transverse dividers providing multiple sub-compartments within said middle compartment;

(c) said sub-compartments comprising:

(i) a first sub-compartment at a said first side of said body, said first sub-compartment being structured and arranged to hold a personal-safety item, and (ii) a second sub-compartment at a said second side of said body, said second sub-compartment being structured and arranged to hold a personal-safety item;

(d) an outside transversely-extending closure flap structured and arranged, when in a closed position, to be placed generally centrally over said body;

(e) said flap having a width of substantially less distance than a length of said middle compartment, and said flap being structured and arranged, when in said closed position, so as to not restrict user access to said first sub-compartment and said second sub-compartment;

(f) a center sub-compartment disposed within said body between said first sub-compartment and said second sub-compartment;

(g) a logo indicia attached to a front surface of said closure flap; and (h) a detachable, adjustable handle for said body means, said handle being user-selectable from a group comprising a first handle and a second handle;

(i) wherein said rear compartment and said front compartment are each zipper-closable;

(j) wherein at least one said zipper-closable compartment comprises a perimeter zipper extending around said compartment for at least about three-fourths of a perimeter of said compartment;

(k) wherein said first handle comprising a shorter briefcase-style handle, and said second handle comprising a longer shoulder-strap-style handle;

(l) wherein said rectangular-box-like body is made of leather;

(m) wherein said rectangular-box-like body has a length dimension of about thirteen inches and a height dimension of about ten inches; and (n) wherein said flap has a said width of at least about two inches less than a said length of said middle compartment, whereby said flap, when in said closed position, does not restrict user access to said first sub-compartment and said second sub-compartment.

* * * * *